US009345341B2

(12) United States Patent
Goppion

(10) Patent No.: US 9,345,341 B2
(45) Date of Patent: May 24, 2016

(54) DISPLAY CASE FOR EXHIBITING OBJECTS

(71) Applicant: GOPPION S.P.A., Trezzano Sul Naviglio (IT)

(72) Inventor: Alessandro Mauro Massimo Goppion, Trezzano Sul Naviglio (IT)

(73) Assignee: GOPPION S.P.A., Trezzano sul Naviglio (MI) (IT)

( * ) Notice: Subject to any disclaimer, the term of this patent is extended or adjusted under 35 U.S.C. 154(b) by 0 days.

(21) Appl. No.: 14/359,757

(22) PCT Filed: Nov. 23, 2012

(86) PCT No.: PCT/IB2012/056659

§ 371 (c)(1),
(2) Date: May 21, 2014

(87) PCT Pub. No.: WO2013/076690

PCT Pub. Date: May 30, 2013

(65) Prior Publication Data

US 2014/0319980 A1 Oct. 30, 2014

(30) Foreign Application Priority Data

Nov. 23, 2011 (IT) ..... MI2011A002127

(51) Int. Cl.

| | |
|---|---|
| ***A47F 3/00*** | (2006.01) |
| ***A47B 45/00*** | (2006.01) |
| *A47F 3/12* | (2006.01) |

(52) U.S. Cl.

CPC ..... *A47F 3/005* (2013.01); *A47B 45/00* (2013.01); *A47F 3/001* (2013.01); *A47F 3/004* (2013.01); *A47F 3/12* (2013.01)

(58) Field of Classification Search

CPC ..... A47F 3/004; A47F 3/005; A47F 3/007; A47F 3/0404; A47B 45/00

USPC ..... 312/114, 119, 122, 138.1, 139.2, 205, 312/201

See application file for complete search history.

(56) References Cited

U.S. PATENT DOCUMENTS

| | | | | |
|---|---|---|---|---|
| 463,932 | A * | 11/1891 | Allison | 312/122 |
| 670,404 | A * | 3/1901 | Davis | 312/114 |

(Continued)

FOREIGN PATENT DOCUMENTS

| | | |
|---|---|---|
| DE | 19543615 | 5/1997 |
| DE | 20220141 | 3/2003 |
| EP | 1438912 | 7/2004 |
| WO | 2008135058 | 11/2008 |

OTHER PUBLICATIONS

International Search Report mailed Feb. 27, 2013 for PCT/IB2012/056659 filed on Nov. 23, 2012 in the name of GOPPION S.P.A.

(Continued)

*Primary Examiner* — James O Hansen

(74) *Attorney, Agent, or Firm* — Steinfl & Bruno LLP

(57) ABSTRACT

A display case for exhibiting objects is described. The display case has a support base for a display plane and for at least a first shell exhibiting at least a crystal delimiting wall, at least a first linear guide for the support of the first shell, the first linear guide exhibiting a part of fixed guide solidly constrained to the base and a part of mobile guide solidly constrained to the first shell, the part of fixed guide exhibiting at least a first rail for one or more first support bearings solidly constrained to the part of mobile guide, the part of mobile guide exhibiting a rail for one or more second support bearings solidly constrained to the part of fixed guide. The display plane being associated to the part of fixed guide by means of one or more third bearings for the support of the display plane.

15 Claims, 9 Drawing Sheets

(56) References Cited

U.S. PATENT DOCUMENTS

| | | | | |
|---|---|---|---|---|
| 5,069,512 | A * | 12/1991 | Sykes | 312/139.2 |
| 6,378,962 | B1 | 4/2002 | Green | |
| 2009/0102331 | A1 * | 4/2009 | Goppion | 312/116 |

OTHER PUBLICATIONS

Written Opinion mailed Feb. 27, 2013 for PCT/IB2012/056659 filed on Nov. 23, 2012 in the name of GOPPION S.P.A.

* cited by examiner

DISPLAY CASE FOR EXHIBITING OBJECTS

CROSS REFERENCE TO RELATED APPLICATIONS

The present application is the US national stage of International Patent Application PCT/IB2012/056659 filed on Nov. 23, 2012 which, in turn, claims priority to Italian Patent Application MI2011A002127 filed on Nov. 23, 2011.

The present invention refers to a display case for exhibiting objects, in particular to a display case suitable for exhibiting objects of collectible art and the like.

It is known that a display case for exhibiting collectible works of art must satisfy precise specifications intended for promoting the viewing of the artwork by minimising obstacles that can penalise the appreciation thereof, promote cleaning of the inner parts of the display case, facilitate the installation of the artwork in the display case without damaging them, and preserve the integrity of the artwork exhibited.

There is often a further complication with the weight, bulk and number of pieces of the collection, which means providing a display case with great sizes and suitable strength.

A display case of this type generally has at least a display plane that is positioned in a display space that is delimited by crystal shells that can slide so as to allow the display space to be closed and opened.

In a known display case of this type there is often the problem that the display plane prevents access to all the inner surfaces of the walls of the crystal shells to inspect and clean them.

Sometimes this type of display case also has a limited movement capability of the walls of the crystal shells thus complicating the installation of the artwork on all of the display plane, especially when it is particularly wide.

Sometimes the movement of the crystal shells, also due to their weight, can generate dangerous vibrations, which when transmitted to the display plane can jeopardise the integrity of the artwork on display.

DE 20220141 U1 describes a display case, in particular for exhibiting valuable products, which comprises a base housing, on which a display plane is formed that is fixed with respect to it, and a cover; the base housing and the cover are fixedly attached through an electrical closing mechanism. The cover is formed by two transparent shells that are suitable for sliding on one another and on the base housing, within the limits of the bulk of such a base housing. In such a way, in a position of maximum opening, in this display case, less than half of the surface of the display plane is freely accessible.

The technical task that the invention proposes is, therefore, that of making a display case for exhibiting objects, particularly artworks, which makes it possible to eliminate the technical drawbacks mentioned in the prior art.

One purpose of the invention is that of making a display case for exhibiting objects, particularly artworks, which makes it possible to easily access the display space for both the installation and for the cleaning and checking of the inner surface of the crystal walls that delimit it.

Another purpose of the invention is that of making a display case for exhibiting objects, particularly artworks, having solidity and structural stability in every configuration thereof, that makes it suitable for exhibiting particularly heavy and bulky objects.

Another purpose of the invention is that of making a display case for exhibiting objects, particularly artworks, that is suitable for preserving the integrity thereof for the whole duration of the exhibition.

Last but not least purpose of the invention is that of making a display case for exhibiting objects, particularly artworks, having a structure that, when its opened or closed configuration varies, the space taken up on the ground remains the same.

The technical task, as well as these and other purposes, are achieved by a display case for exhibiting objects according to claim 1 described in the rest of the description.

Other characteristics of the present invention are defined, moreover, in the following claims.

Further characteristics and advantages of the invention shall become clearer from the description of a preferred but not exclusive embodiment of the display case for exhibiting objects, particularly artworks, according to the finding, illustrated as an indication and not for limiting purposes in the attached drawings, in which.

Figure 1:
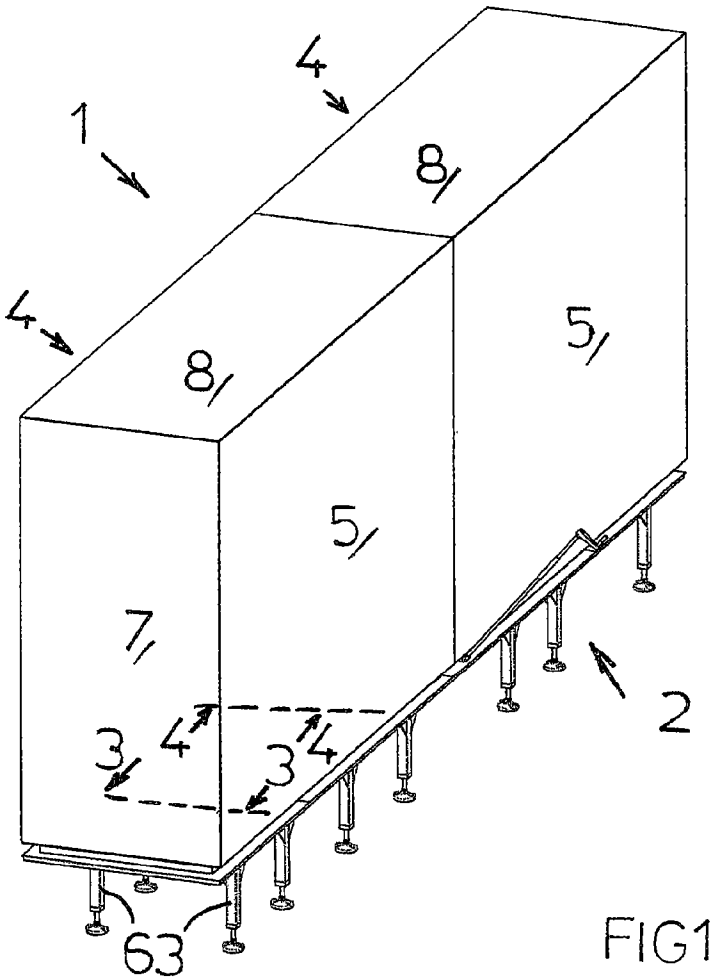
FIG. 1 shows an axonometric view of the display case completely closed.
Figure 2:
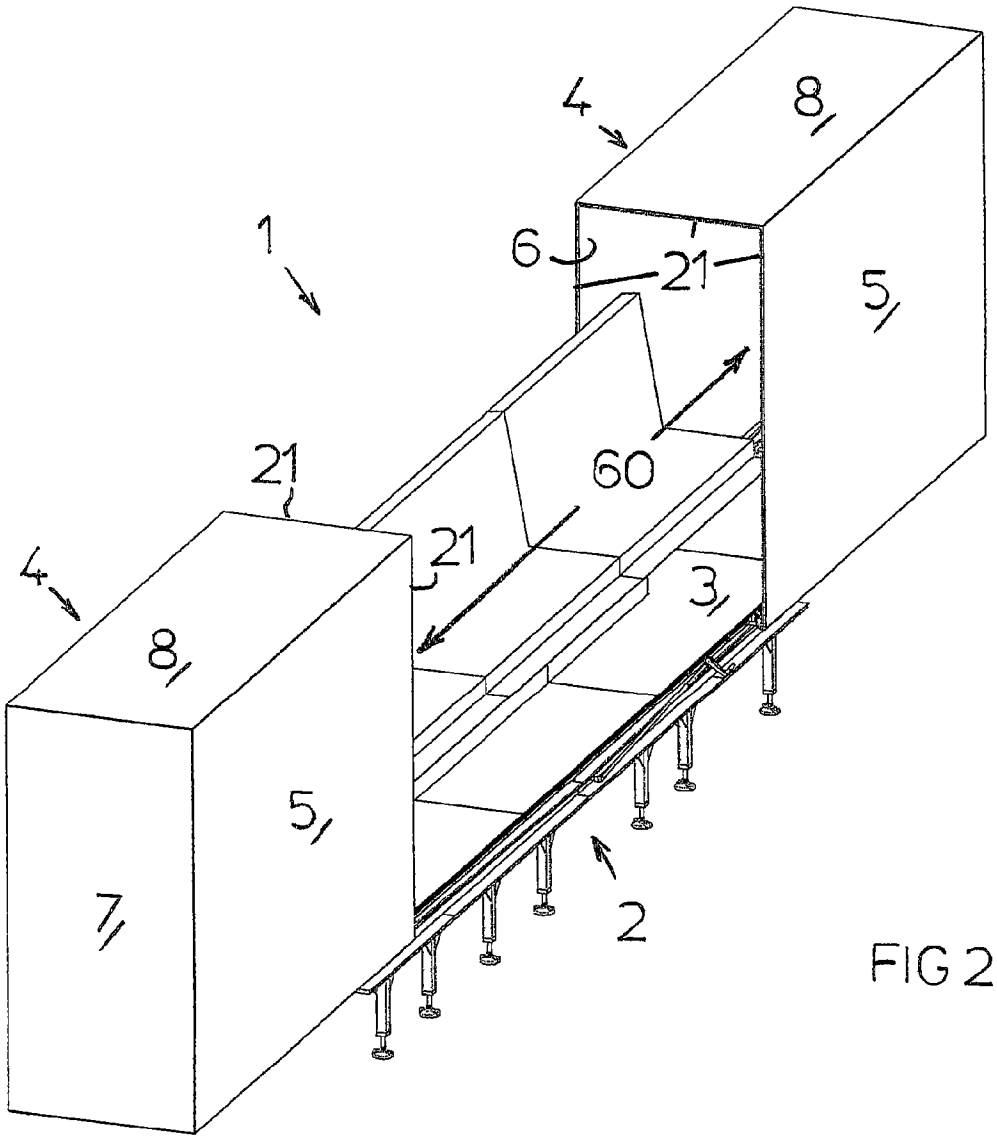
FIG. 2 shows an axonometric view of the display case completely open.
Figure 3:
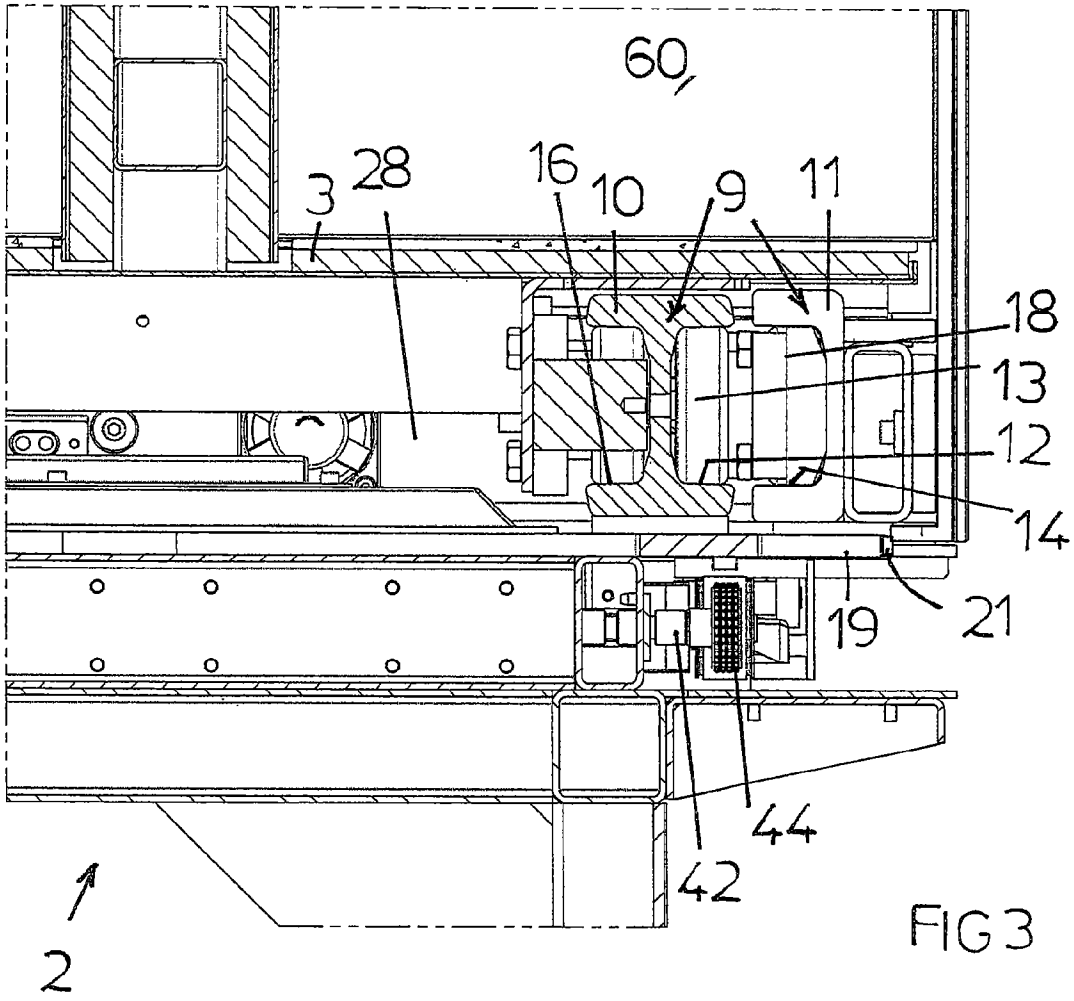
FIG. 3 shows a section view of the display case along the line 3-3 of FIG. 1.
Figure 4:
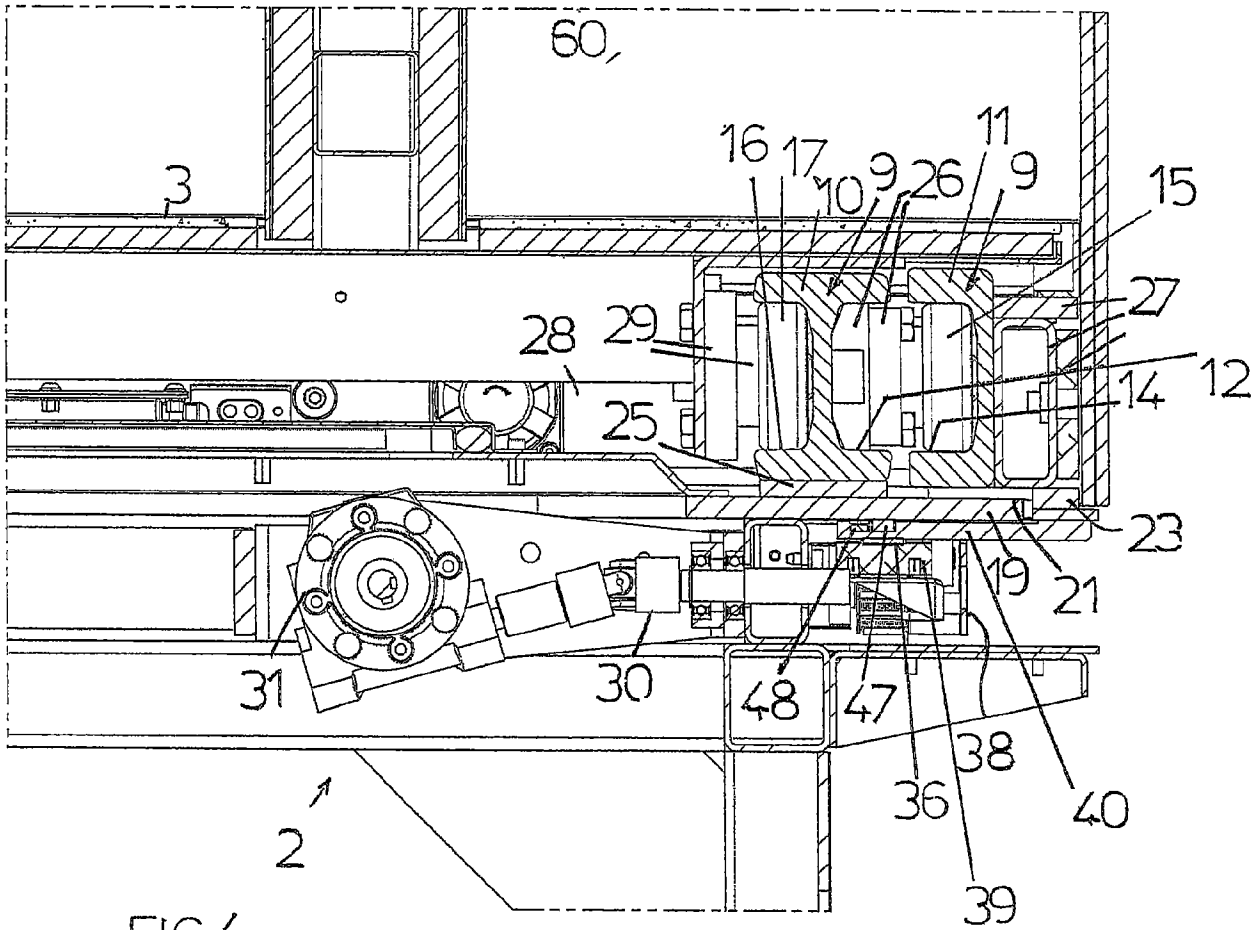
FIG. 4 shows a section of the display case along the line 4-4 of FIG. 1.
Figure 5:
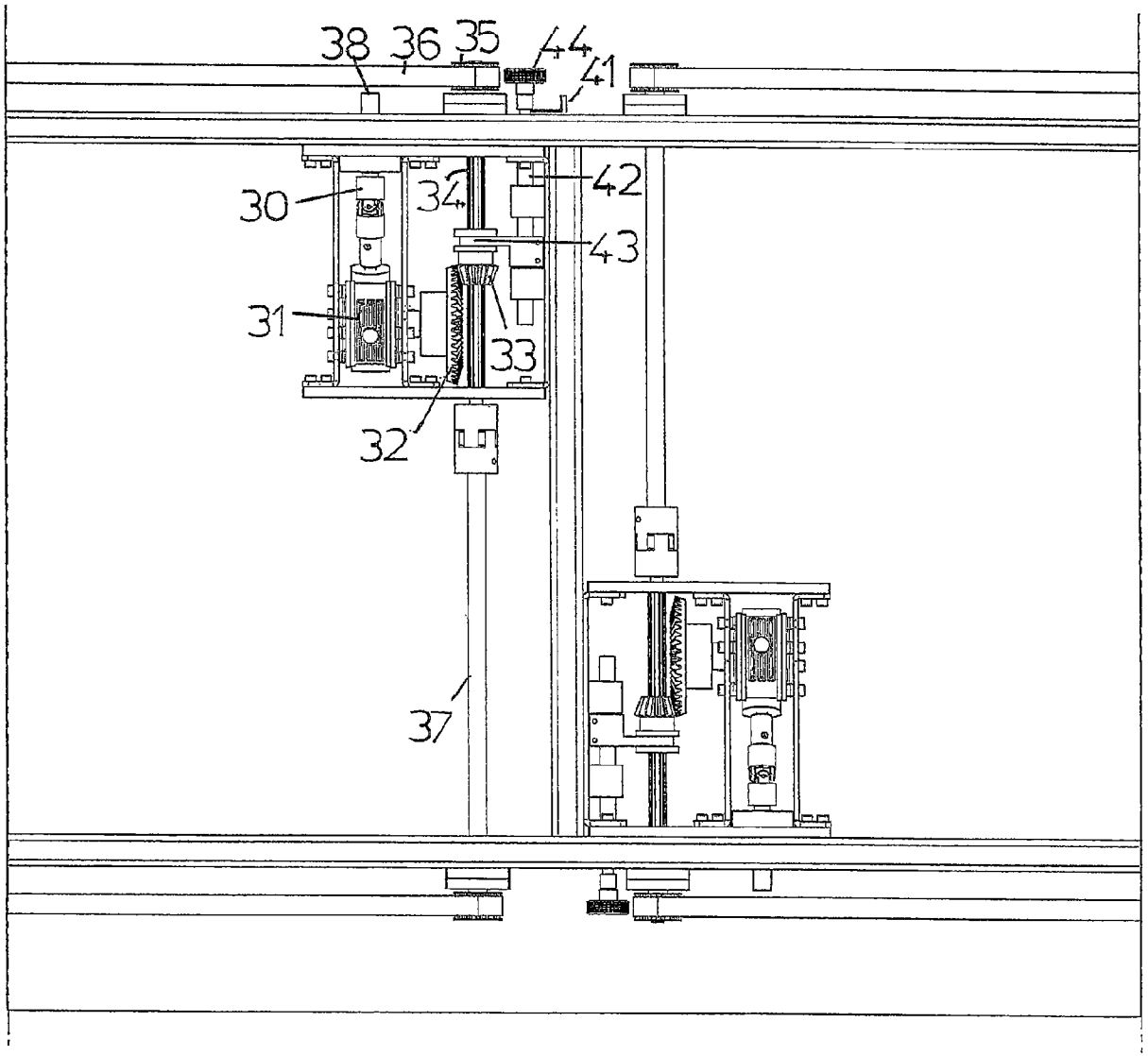
FIG. 5 shows a plan view of the portion of the base in which the devices for actuating the shells are provided.
Figure 6A:
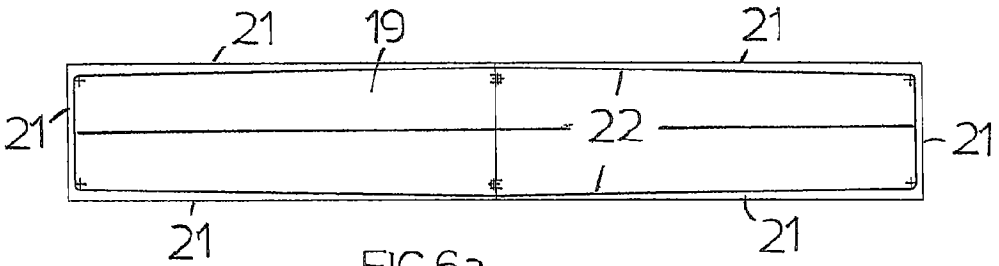
Figure 6B:
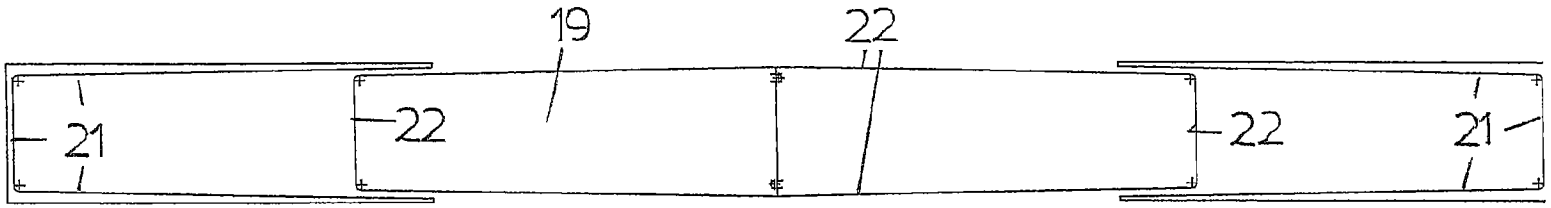
Figure 8:
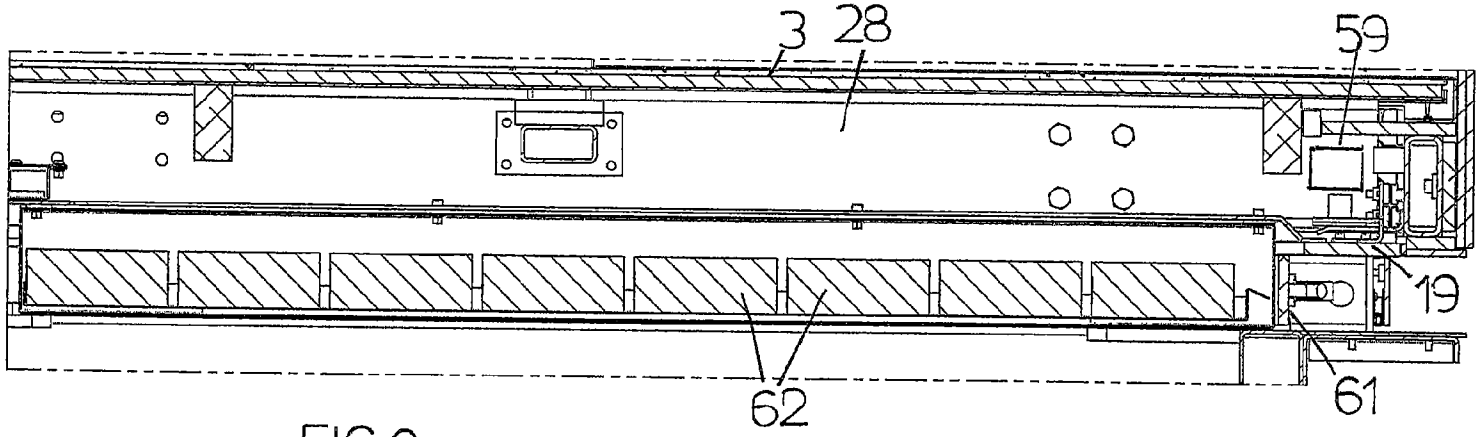
Figure 7:
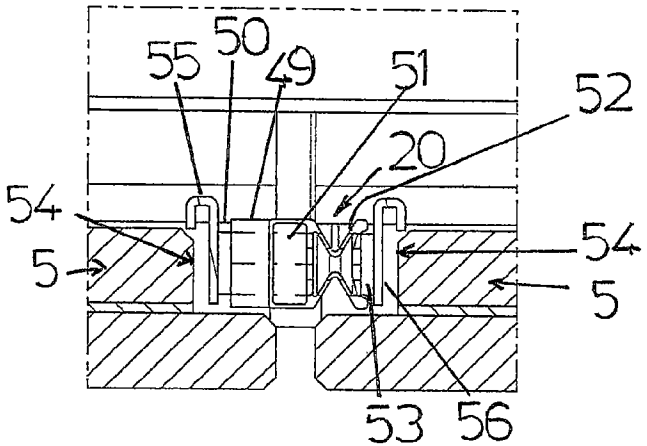
Figure 9:
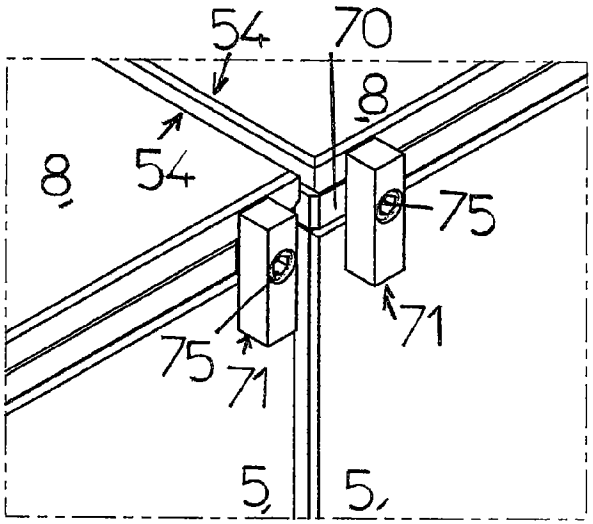
Figure 10:
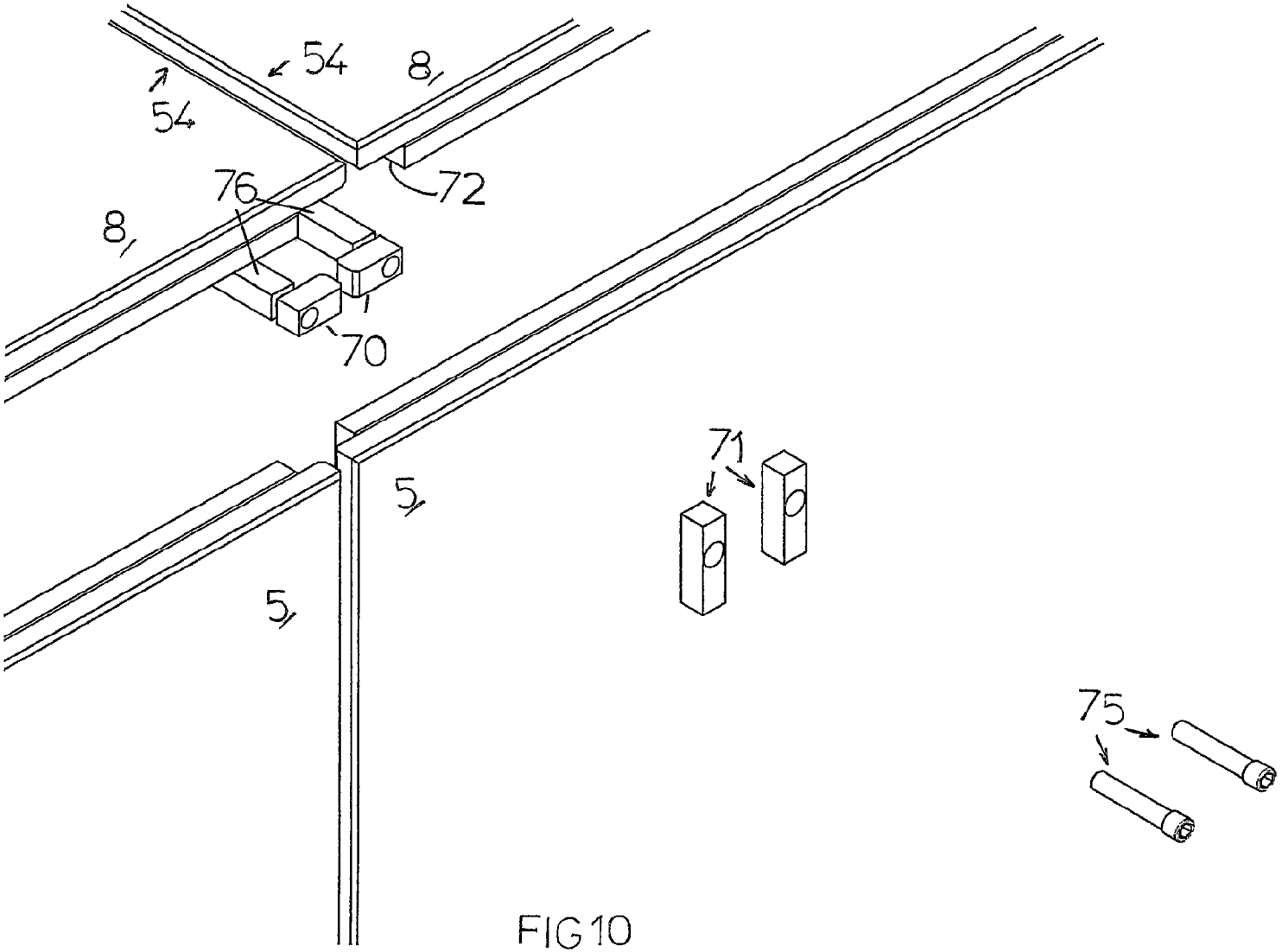

FIG. 6*a* schematically shows the relative positioning between the fixed plane of the base and the second gasket when the display case is completely closed;

FIG. 6*b* schematically shows the positioning between the fixed plane of the base and the second gasket when the display case is completely open;

FIG. 7 shows a detail of the juxtaposition area between the shells when the display case is completely closed;

FIG. 8 shows the base vertically sectioned at the drawer in which the hygroscopic means are housed, for dehumidifying the air present inside the hermetically closed chamber delimited between the fixed plane of the base and the crystal shells;

FIG. 9 shows a security retaining system for the flat upper horizontal wall of the shells;

FIG. 10 shows an exploded view of the security retaining system illustrated in FIG. 9.

With reference to the mentioned figures, a display case is shown for exhibiting objects, in particular artwork, wholly indicated with reference numeral 1.

The display case 1 comprises a support base 2 for at least a display plane 3 and for at least a first shell, and in particular for two shells 4, having at least one, and in particular many delimiting walls made from crystal 5, 6, 7, 8.

Preferably, the base is equipped with feet 63 that can be adjusted in height so as to vary the distance of the shells 4 from the ground.

The crystal shells 4 are suitable for delimiting, with the display plane 3, the display space of the display case 1.

The crystal shells 4 are preferably identical in shape and configuration.

The crystal walls 5, 6, 7, 8 of the shells 4 preferably have a layered structure.

In particular each crystal shell 4 is parallelepiped-shaped and exhibits a vertical flat front wall 5, a vertical flat back wall 6 that is opposite to the front wall 5, a vertical flat outer side wall 7, and a horizontal flat upper wall 8.

The invention comprises one or more first linear guides 9 for supporting the bi-directional sliding of at least one shell 4 between a retracted position on the base 2 and a position that projects from the base 2.

Preferably two first linear guides 9 are provided that are opposite one another and cooperate for supporting the bi-directional sliding of at least one shell 4 between a retracted position on the base 2 and a position that projects from the base 2.

Preferably for each shell 4 two first linear guides 9 are provided that are opposite one another and cooperate for supporting the bi-directional sliding between a retracted position on the base 2 and a position that projects from the base 2.

Preferably, the two first linear guides 9 are identical to one another and are configured and arranged in a way such as to define, for the shells 4, a common bi-directional sliding direction that is perpendicular to their outer side walls 7.

The shells 4 in the retracted position are juxtaposed in such a way as to create, with a fixed plane 19 of the base 2, a chamber 60 that is hermetically closed by means of a first gasket 20 connecting between the juxtaposed perimeter edges 54 of the shells 4 and a second gasket 21 for connecting the shells 4 with the perimeter edge 22 of the fixed plane 19 of the base 2.

In particular the shells 4 have, along the perimeter of their base, a perpendicular inward facing flange 23 which brings the second gasket 21, which in the retracted position of the shells 4 engages with the perimeter edge of the fixed plane 19, which is arranged lying horizontally at the height of the base of the shells 4.

La first gasket 20 is magnetic and preferably comprises an abutment element in ferrite rubber 49 applied through a double-sided tape layer 50 to a profile 55 that is fixed along the perimeter edge 54 of the inner crystal layer of one of the shells 4, and a magnetic gasket element 51 exhibiting an elastically yieldable part 52 that is applied through a double-sided tape layer 53 to a flange 56 that is fixed along the perimeter edge 54 of the inner crystal layer of the other shell 4.

The perimeter edge 54 of the inner crystal layer of the shells 4 to which the gasket 20 is applied, is retracted with respect to the perimeter edge 54 of the external crystal layer of the shells 4 so that the part of the outer crystal layer of the shells 4 projecting beyond the inner crystal layer of the shells 4 acts as a protection for the gasket 20.

The second gasket 21 has a shape that matches the fixed plane 19 that in turn advantageously exhibits a wedge configuration.

In such a way only when the end closing position of the shells 4 has been reached the second gasket 21 comes into contact with the perimeter edge of the fixed plane 19 substantially without rubbing, whereas during the initial closing step of the shells 4 the second gasket 21 remains distant from the perimeter edge of the fixed plane 19, and consequently, it is not subject to wearing through rubbing.

Each first linear guide 9 has a fixed guide portion 10 that is solidly constrained to the base 2 and a mobile guide portion 11 that is solidly constrained to the shell 4.

The part of fixed guide portion 10 exhibits a first rail 12 for one or more first support bearings 13 that are solidly constrained to part of the mobile guide portion 11.

The part of mobile guide portion 11 exhibits a rail 14 for one or more second support bearings 15 that are solidly constrained to part of the fixed guide portion 10.

The display plane 3 is associated with the part of fixed guide portion 10 by means of one or more third support bearings 17.

Preferably the third support bearings 17 are solidly constrained to the display plane 3 and the part of fixed guide portion 10 exhibits a second rail 16 that is parallel to the first rail 12 for the third support bearings 17.

In such a way the display plane 3 is supported with the possibility of bi-directional sliding parallel and independent with respect to the shell 4.

The first linear guides 9 are positioned in the compartment 28 present between the display plane 3 and the fixed plane 19 and project horizontally, the first being parallel and adjacent to the front wall 5 of the shell 4, and the second one being parallel and adjacent to the rear wall 6 of the shell 4.

The part of fixed guide portion 10 of the first linear guides 9 is connected to the fixed plane 19 through a fixing plate 25, the part of mobile guide portion 11 of the first front linear guide 9 and of the first rear linear guide 9, respectively, is connected to the front wall 5 and to the rear wall 6 of the shell 4, respectively, through fixing elements 27.

The third support bearings 17 are connected to the lower side of the display plane 3 through fixing elements 29.

The invention preferably comprises, for the first front linear guide 9 and respectively for the first rear linear guide 9, a single first support bearing 13 that is fixed cantilevered through fixing plates 18 in an area of the part of mobile guide portion 11 that is adjacent to the inner side perimeter edge 21 of the front wall 5 of the shell 4 and respectively of the rear side wall 6 of the shell 4, and a single second bearing 15 that is fixed cantilevered through fixing plates 26 in an area of the part of fixed guide portion 10 that is adjacent to the side perimeter edge of the fixed plane 19.

The dislocation and the number of bearings 13 and 15 is such that for any position of the shell 4 the bearings 13 and 15 remain permanently engaged along the rails 12 and 14 of the respective guide parts 10 and 11 so as to ensure sliding of the shell 4 without bumps and without undesired vibrations.

Preferably, the rotation axes of the first bearings 13, of the second bearings 15 and of the third bearings 17 are parallel to one another and lie on a single plane that in particular is parallel to the fixed plane 19 and to the display plane 3.

Preferably the part of fixed guide portion 10 is a longitudinal profile with a cross sectional section in a double-T shape defining, with the opposite compartments thereof, the first rail 12 and the second rail 16.

Preferably the part of fixed guide portion 10 of the front linear guide 9 of both the shells 4 is made with a single longitudinal profile that is common to the two shells 4, and analogously the part of fixed guide portion 10 of the rear linear guide 9 of both the shells 4 is made with a single longitudinal profile that is common to the two shells 4.

The support of the two shells 4 and of the display plane 3 is thus equally divided into the two longitudinal profiles in a double-T shape.

The display case advantageously comprises also at least one device for moving at least one shell 4, mounted on the base 2 at the lower side of the fixed plane 19.

Preferably, as shown, each shell 4 has its own independent movement device, one that can be actuated preferably from the front side of the display case 1 and the other that can be actuated preferably from the rear side of the display case 1.

The movement device of the shell 4 comprises a shaft 30 for taking the rotation connected to a reducer 31 in turn connected, via a bevel gear 32, 33 comprising a bevel pinion 33 and a crown gear 32, to a primary drive shaft 34 for transmission of rotation to at least a first pulley 35 for drawing at least a first belt 36 solidly constrained to the shell 4.

The belt 36 has a joint block 39, 40 for connecting its ends in such a way as to form a closed ring and it is wound around the first pulley 35 that acts as a driving pulley and around a driven pulley (not shown) that is opposite to the driving pulley.

The first belt 36 is solidly constrained to the shell 4 through fixing of the joint block 39, 40 to the flange 23 provided at the base of the front wall 5 of the shell 4.

The shaft 30 has an impression 38 at the free end which is accessible from the front of the display case for the engagement of a handle or alternatively of the output shaft of a motor.

The primary drive shaft 34, which projects perpendicular to the front and rear walls 5 and 6 of the shell 4, is coaxially joined to a secondary shaft 37 for transmission of the rotation to a second pulley 35 for drawing a second belt 36.

The second belt 36, analogously to the first belt 36, has a block 39, 40 for connecting its ends so as to form a closed ring and it is wound around the second pulley 35 that acts as a driving pulley and around a driven pulley (not shown) that is opposite to the driving pulley.

The second belt 36 is solidly constrained to the shell 4 through fixing of the joint block 39, 40 to the flange 23 provided at the base of the rear wall 6 of the shell 4.

The pulleys 35 and the relative driven pulleys have coplanar rotation axes that are perpendicular to the front and rear walls 5 and 6 of the shell 4 that are suitable for causing a movement of the shell 4 in its sliding direction perpendicular to its side wall 7.

The movement device of the first shell 4 is located in a frontal position below the first shell 4, the movement device of the second shell 4 is analogous to that described above and is located in a rear position below the second shell 4.

Advantageously a device is provided for releasing the shell 4 from its movement device.

The drive shaft 34 indeed supports a first element 33 of the bevel gear 32, 33 in a slidable manner between a position that is engaged with the second element 32 of the bevel gear 32, 33 and a position that is disengaged from the second element 32 of the bevel gear 32, 33.

In particular on the drive shaft 34, preferably of the grooved type, the first element 33 of the bevel gear 32, 33, is mounted, which through suitable blocking means can be selectively held engaged or disengaged from the second element 32 of the bevel gear 32, 33.

The blocking means, also mounted on the base 2, comprise a small shaft 42 that can translate supporting in a fixed manner a slide 43 in turn supporting the first element 33 of the bevel gear 32, 33 translating as a unit.

The small shaft 42 is oriented parallel to the shaft 34 and it can be actuated in bi-directional translation along its axis by pushing or pulling a suitable handle 44 that is applied on top of the small shaft 42 itself.

The small shaft 42 can be blocked through a fork 41 that can be engaged in a throat of the small shaft 42 once the position corresponding to the engagement or disengagement condition of the bevel gear 32, 33 has been reached.

In the disengaged condition of the bevel gear 32, 33 the shell 4 is released from the movement device and can therefore be moved manually, which is essential when its movement device is out of order.

Advantageously, a guide for sliding the joint block 39, 40 in the sliding direction of the shell 4 is provided.

This makes it possible to prevent the shell 4 from oscillating crosswise with respect to its sliding direction.

In particular the guide for sliding the joint block 39, 40 comprises a groove 46 that is present on the upper half-part 40 of the joint block 39, 40 and a profile 47 with a shape that matches the groove 46 that is supported cantilevered at the lower side of the fixed plane 19.

Preferably between the groove 46 and the profile 47 roller bearings 48 are interposed for improving the relative sliding between the two parts.

In the compartment 28 a ventilator is advantageously positioned 59 for recycling air present inside the hermetically closed chamber 60.

The compartment 28 is in communication with at least one extractable drawer 61 in which suitable hygroscopic means are positionable for dehumidifying the air present inside the hermetically closed chamber 60.

With reference now to FIGS. 9 and 10, a security retaining system for the upper horizontal delimiting wall 8 of the shell 4 is shown.

The retaining system comprises at least one retaining member 71 supported by a corresponding support member 70 fixed in an undercut 72 of the perimeter edge 54 of the upper horizontal delimiting wall 8 of the shell 4.

The retaining member 71 is supported in position outside one end of the perimeter edge 54 of the upper horizontal delimiting wall 8 of the shell 4.

The retaining member 71 is arranged and configured such as to lock against the external surface of one from the front 5 or rear 6 walls for vertically delimiting the shell 4.

The retaining member 71 in particular is fixed through a screw 75 to the support member 70.

The support member 70 is fixed inside the undercut 72 in a position that is adjacent to one end of a bar 76 for supporting the gasket 20.

In the specific application for each shell 4 a retaining member 71 is provided that locks against the external surface of the front vertical delimiting wall 5 of the shell 4 and a retaining member 71 that locks against the external surface of the rear vertical delimiting wall 6 of the shell 4.

Thanks to this retaining system the shell 4, even in the case in which there is yielding of the glue between its delimiting walls, does not open and does not allow its upper delimiting wall 8 to fall thus preventing artworks possibly present inside the display case 1 from being damaged.

It has basically been seen how the invention is particularly advantageous for the fact that it comprises a large display case, for example up to 8 meters long, which can be opened thanks to linear guides that are suitably studied and conceived for supporting a heavy load, without requiring additional accessories for supporting the shells such as trolleys or supporting wheels which would take up space that, on the other hand, thanks to the present invention remains free below the shells in the opened configuration of the display case.

The specific concept of the opposite linear guides makes it possible for there to be an easy and smooth opening without shaking that could be transmitted to the artworks.

The gasket system makes it possible for there to be an excellent air-tight seal.

The display plane that can slide independently from the shells offers the user the possibility of accessing inside the display space in a simple manner for installing and for easily and quickly cleaning the crystal.

The display case thus conceived can undergo numerous modifications and variants, all covered by the inventive concept; moreover, all the details can be replaced by technically equivalent elements.

For example, the shape of the shells can be different from that illustrated, i.e. a single mobile shell and one fixed shell may be provided, or two mobile shells spaced apart by a fixed shell, and so on.

Moreover, an electric motor can be provided for moving the shells.

The display case according to the invention is manoeuvrable, despite its bulk and weight, in an extremely simple manner even by a single person.

Moreover, the configuration of the display case according to the invention makes it possible to position the base of the shells at a very close distance to the ground, for example in a version of the base which does not foresee feet.

In practice the materials used, as well as the sizes, can be any according to the requirements and to the state of the art.

The invention claimed is:

1. A display case for exhibiting objects, comprising:

a support base for at least one display plane and for at least a first shell comprising at least one crystal delimiting wall, said at least a first shell being suitable for delimiting with said at least one display plane at least a portion of display space, and at least one first linear guide for supporting said at least a first shell slidably bi-directionally between a retracted position on the base and a position that projects from the base, said at least one first linear guide comprising a fixed guide portion solidly constrained to the base and a mobile guide portion solidly constrained to the first shell, said fixed guide portion comprising at least one first rail for one or more first support bearings solidly constrained to said mobile guide portion, said mobile guide portion comprising a rail, parallel to said at least one first rail of said fixed guide portion, for one or more second support bearings solidly constrained to said fixed guide portion, and said display plane being associated to said fixed guide portion by means of one or more third bearings for the support of the display plane slidably independently and parallel to said first shell, wherein rotation axes of said one or more first, second and third bearings are parallel and coplanar.

2. The display case for exhibiting objects according to claim 1, wherein said one or more third support bearings are solidly constrained to said display plane, and said fixed guide portion exhibits a second rail parallel to said first rail for said one or more third support bearings.

3. The display case for exhibiting objects according to claim 1, further comprising a second shell suitable for delimiting the whole display case in combination with said first shell and said display plane, said second shell being supported slidingly bi-directionally parallel and independently with respect to said first shell between a retracted position on the base and a position projecting from the base, said first and second shell in the retracted position thereof being juxtaposed to create, with a fixed plane of the base, a chamber hermetically closed by means of a first connecting gasket between the juxtaposed perimeter edges of said first and second shell and a second connecting gasket of the first and second shell with the perimeter edge of said fixed plane of said base.

4. The display case for exhibiting objects according to claim 3, further comprising a movement device of said at least a first shell positioned on a lower side of said fixed plane.

5. The display case for exhibiting objects according to claim 4, wherein said movement device comprises a shaft for taking rotation connected to a reducer in turn connected, via a bevel gear, to a primary drive shaft for transmission of the rotation to at least one first pulley for drawing at least one first belt solidly constrained to said first shell.

6. The display case for exhibiting objects according to claim 5, wherein said drive shaft supports a first element of the bevel gear slidably between an engaged position with the second element of the bevel gear and a disengaged position from the second element of the bevel gear, there being further comprised blocking means of the first element of the bevel gear in the engaged and disengaged position.

7. The display case for exhibiting objects according to claim 5, further comprising a guide for sliding of the joint block of ends of said first belt in the sliding direction of said at least one first shell.

8. The display case for exhibiting objects according to claim 3, wherein said first gasket is magnetic.

9. The display case for exhibiting objects according to claim 3, wherein said fixed plane exhibits a wedge configuration and said second gasket exhibits a conformation that is complementary to said fixed plane.

10. The display case for exhibiting objects according to claim 3, wherein, internally of a compartment present between the display plane and the fixed plane, a ventilator is located for recycling air present internally of said hermetically closed chamber, at least an extractable drawer further being provided, in communication with said compartment in which hygroscopic means are positionable for dehumidifying the air inside said hermetically-closed chamber.

11. The display case for exhibiting objects according to claim 1, wherein the at least one first linear guide are two opposite first linear guides for supporting the bi-directional sliding at least of the first shell.

12. The display case for exhibiting objects according to claim 1, wherein said fixed guide portion is a longitudinal profile with a cross sectional section in a double-T shape, defining, with the opposite compartments thereof, said first and second rail.

13. The display case for exhibiting objects according to claim 1, further comprising a security retaining system for an upper horizontal delimiting wall at least of the first shell, said retaining system comprising at least a retaining member supported by a corresponding support member fixed in an undercut of a perimeter edge of an upper horizontal delimiting wall of the first shell, said retaining member being supported in an external position to an end of said perimeter edge and being arranged and configured such as to lock against the external surface of a vertical delimiting wall of the first shell.

14. A display case for exhibiting objects, comprising:

a support base for at least one display plane and for at least a first shell comprising at least one crystal delimiting wall, said at least a first shell being suitable for delimiting with said at least one display plane at least a portion of display space;

at least one first linear guide for supporting said at least a first shell slidably bi-directionally between a retracted position on the base and a position that projects from the base, said at least one first linear guide comprising a fixed guide portion solidly constrained to the base and a mobile guide portion solidly constrained to the first shell, said fixed guide portion comprising at least one first rail for one or more first support bearings solidly constrained to said mobile guide portion, said mobile guide portion comprising a rail, parallel to said at least one first rail of said fixed guide portion, for one or more second support bearings solidly constrained to said fixed guide portion, and said display plane being associated to said fixed guide portion by means of one or more third bearings for the support of the display plane slidably independently and parallel to said first shell;

a second shell suitable for delimiting the whole display case in combination with said first shell and said display plane, said second shell being supported slidingly bi-directionally parallel and independently with respect to said first shell between a retracted position on the base and a position projecting from the base, said first and second shell in the retracted position thereof being juxtaposed to create, with a fixed plane of the base, a chamber hermetically closed by means of a first connecting gasket between the juxtaposed perimeter edges of said first and second shell and a second connecting gasket of the first and second shell with the perimeter edge of said fixed plane of said base; and a movement device of said at least a first shell positioned on a lower side of said fixed plane, wherein said movement device comprises a shaft for taking rotation connected to a reducer in turn connected, via a bevel gear, to a primary drive shaft for transmission of the rotation to at least one first pulley for drawing at least one first belt solidly constrained to said first shell.

15. A display case for exhibiting objects, comprising:

a support base for at least one display plane and for at least a first shell comprising at least one crystal delimiting wall, said at least a first shell being suitable for delimiting with said at least one display plane at least a portion of display space;

at least one first linear guide for supporting said at least a first shell slidably bi-directionally between a retracted position on the base and a position that projects from the base, said at least one first linear guide comprising a fixed guide portion solidly constrained to the base and a mobile guide portion solidly constrained to the first shell, said fixed guide portion comprising at least one first rail for one or more first support bearings solidly constrained to said mobile guide portion, said mobile guide portion comprising a rail, parallel to said at least one first rail of said fixed guide portion, for one or more second support bearings solidly constrained to said fixed guide portion, and said display plane being associated to said fixed guide portion by means of one or more third bearings for the support of the display plane slidably independently and parallel to said first shell; and a second shell suitable for delimiting the whole display case in combination with said first shell and said display plane, said second shell being supported slidingly bi-directionally parallel and independently with respect to said first shell between a retracted position on the base and a position projecting from the base, said first and second shell in the retracted position thereof being juxtaposed to create, with a fixed plane of the base, a chamber hermetically closed by means of a first connecting gasket between the juxtaposed perimeter edges of said first and second shell and a second connecting gasket of the first and second shell with the perimeter edge of said fixed plane of said base, wherein, internally of a compartment present between the display plane and the fixed plane, a ventilator is located for recycling air present internally of said hermetically closed chamber, at least an extractable drawer further being provided, in communication with said compartment in which hygroscopic means are positionable for dehumidifying the air inside said hermetically-closed chamber.

* * * * *